US006394514B1

(12) United States Patent
Kidd

(10) Patent No.: US 6,394,514 B1
(45) Date of Patent: May 28, 2002

(54) SELF-BAGGING WASTE COLLECTION DEVICE

(76) Inventor: Randall E Kidd, 14650 Rosholt Loop, Colorado Springs, CO (US) 80921-2000

( * ) Notice: Subject to any disclaimer, the term of this patent is extended or adjusted under 35 U.S.C. 154(b) by 0 days.

(21) Appl. No.: 09/467,230

(22) Filed: Dec. 20, 1999

(51) Int. Cl.[7] ..... A01K 29/00; E01H 1/12
(52) U.S. Cl. ..... 294/1.4
(58) Field of Search ..... 294/1.3–1.5, 1.1, 294/55; 15/257.1, 257.3, 257.4, 257.7; 248/95, 99–101

(56) References Cited

U.S. PATENT DOCUMENTS 3,659,891 A * 5/1972 Pettenon et al. ..... 294/1.4
4,146,259 A * 3/1979 Schultz ..... 294/1.4
4,279,437 A * 7/1981 Goldbarg ..... 294/1.4
4,349,224 A * 9/1982 Shiozaki ..... 294/1.4
D267,593 S * 1/1983 Crawford et al. ..... 294/1.4
4,457,549 A * 7/1984 Lowery ..... 294/1.4
5,799,993 A * 9/1998 Lafferty ..... 294/1.4
5,868,447 A * 2/1999 Clark et al. ..... 294/1.4
5,915,769 A * 6/1999 Kidd ..... 294/1.4
6,039,369 A * 3/2000 Stahovic ..... 294/1.4

* cited by examiner

*Primary Examiner*—Dean J. Kramer

(57) ABSTRACT

A sanitary device for collecting and disposing of waste comprising a handle with a rigid frame at the lower end. The frame supports a removable plastic bag. The bag and contents are disposed when the collection procedure is completed. The bags used are typically the plastic bags with handles used in most grocery and other retail stores.

14 Claims, 13 Drawing Sheets

SELF-BAGGING WASTE COLLECTION DEVICE

BACKGROUND OF INVENTION

There are several waste collection device designs that will utilize a bag for collecting and disposing of waste; most require special or purchased bags. The purpose of this invention is to provide an economical means of collecting and disposing waste using plastic bags with handles that are readily available from most grocery and other retail stores. This invention provides a secondary use for a bag that is typically discarded after it is emptied of contents purchased at retail outlets.

SUMMARY OF THE INVENTION

The disclosed inventive device improves on the device disclosed in U.S. Pat. No. 5,915,769 (the '769 patent). The new attachment means is simpler and provides a quicker and easier method to attach bags. The '769 patent used protrusions that captivated most of the bag handle opening. This new design requires only small attachment points to retain the bag in proper working position. The new design also provides a different means to attach the handle to the frame. The new attachment means results in significantly greater tension in the fit of the bag along the perimeter of the frame. The new design also provides a more efficient method of manufacture. The new design reduces the amount of material used and also provides designs that adapt to a plastic molding process as well as to metal fabrication.

BRIEF DESCRIPTION THE DRAWINGS

Figure 20:
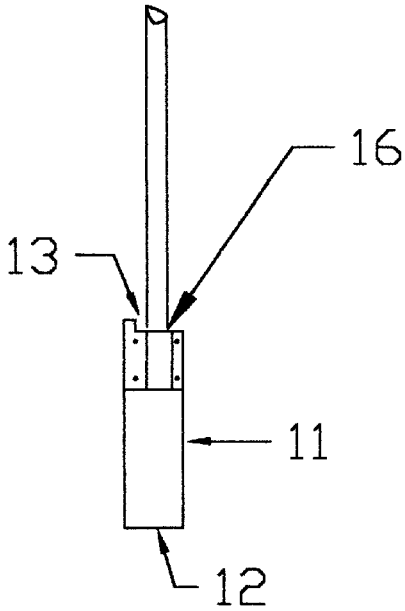

FIG. 20 is a left side elevation view of a straight squared frame with extensions, the right side being a mirror image of the left side shown. The extension can be positioned on back, front, or both. Shown with back extension.

Figure 21:
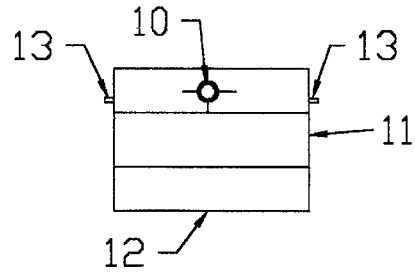

FIG. 21 is a top elevation view of a rectangular angled straight pass through frame with attachments.

Figure 22:
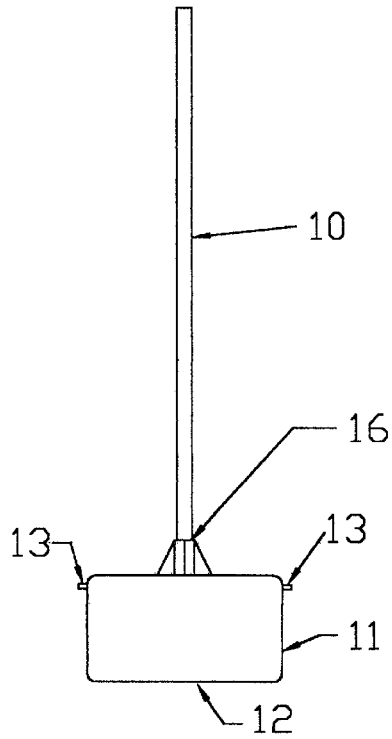

FIG. 22 is a front elevation view of a rectangular angled straight pass through frame with attachments.

Figure 23:
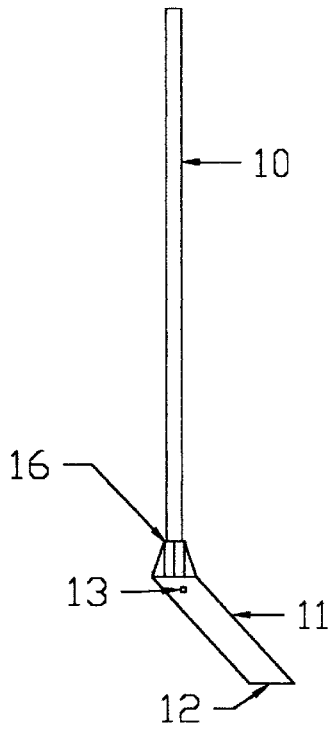

FIG. 23 is a left side elevation view of a rectangular angled straight pass through frame with attachments, the right side being a mirror image of the left side shown.

Figure 24:
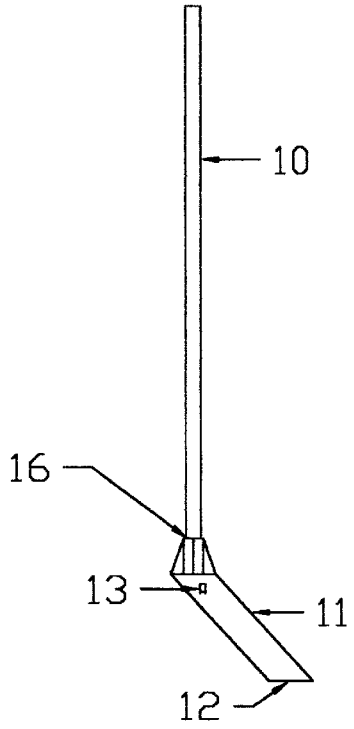

FIG. 24 is a left side elevation view of a rectangular angled straight pass through frame with tabs, the right side being a mirror image of the left side shown.

Figure 25:
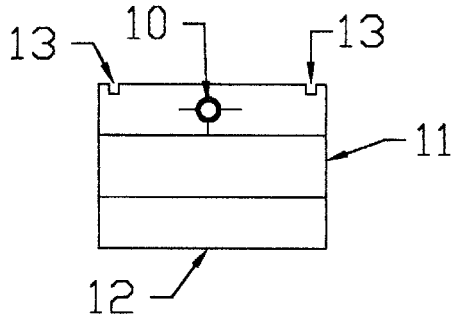

FIG. 25 is a top elevation view of a rectangular angled straight pass through frame with cutouts.

Figure 26:
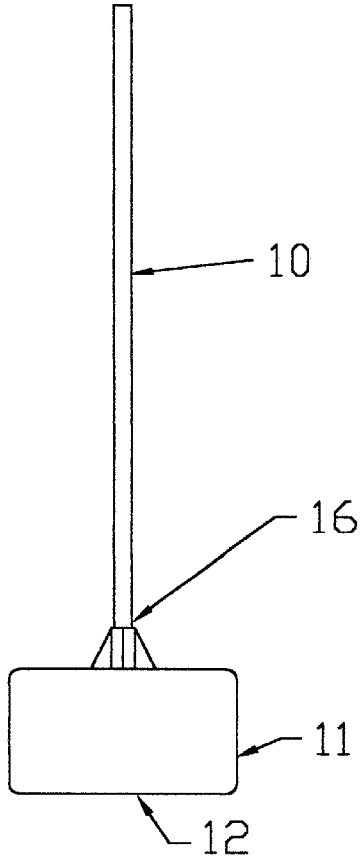

FIG. 26 is a front elevation view of a rectangular angled straight pass through frame with cutouts.

Figure 27:
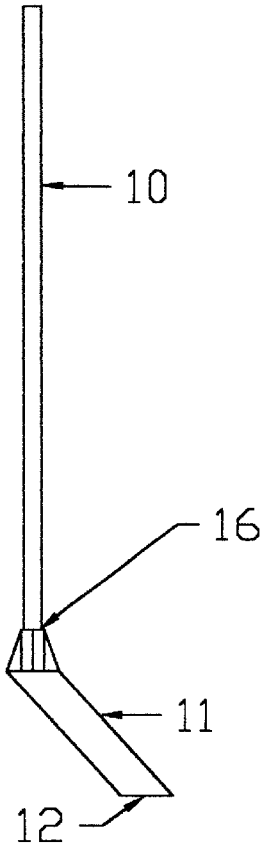

FIG. 27 is a lade elevation view of a rectangular angled straight pass through frame with cutouts, the right side being a mirror image of the left side shown.

Figure 28:
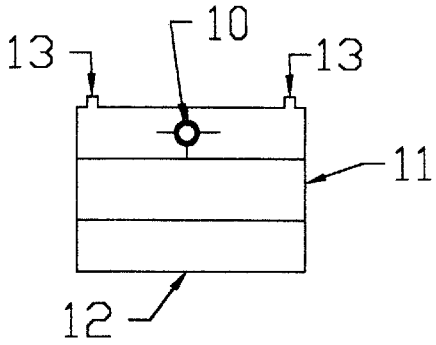

FIG. 28 is a top elevation view of a rectangular angled straight pass through frame with extensions.

Figure 29:
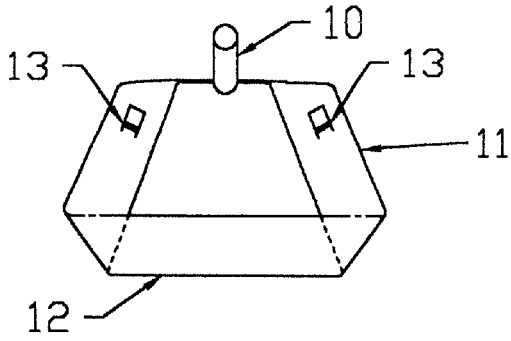

FIG. 29 is a top elevation view of a trapezoidal frame with tabs.

Figure 30:
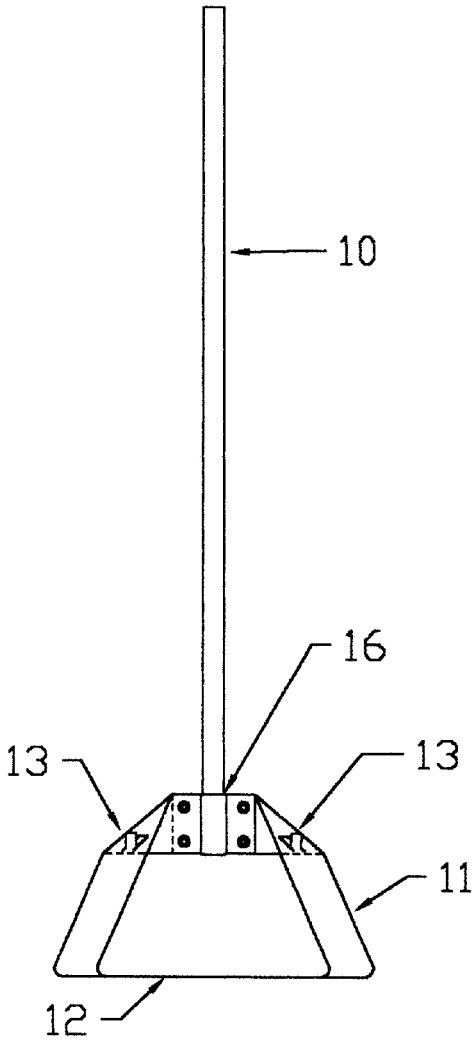

FIG. 30 is a front elevation view of a trapezoidal frame with tabs.

Figure 31:
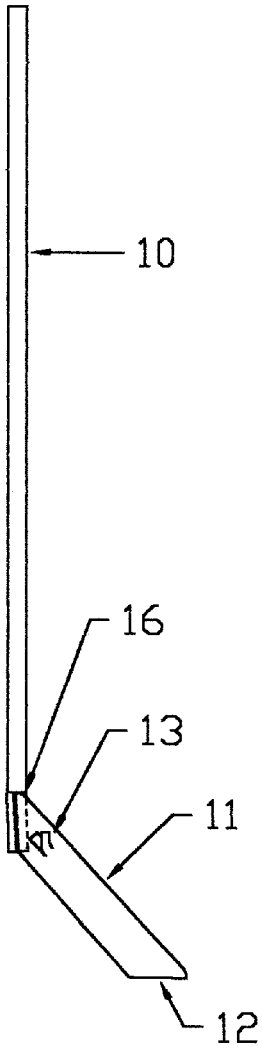

FIG. 31 is a left side elevation view of a trapezoidal frame with tabs, the right side being a mirror image of the left side shown.

Figure 32:
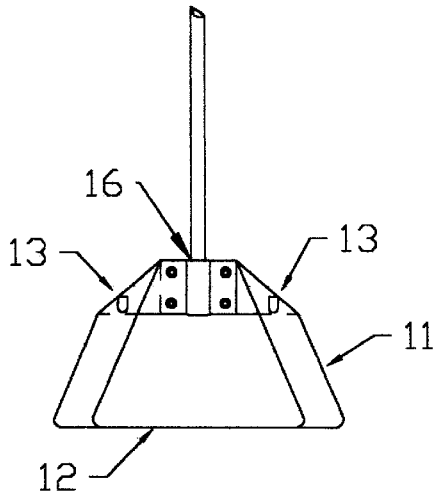

FIG. 32 is a front elevation view of a trapezoidal frame with attachments.

Figure 33:
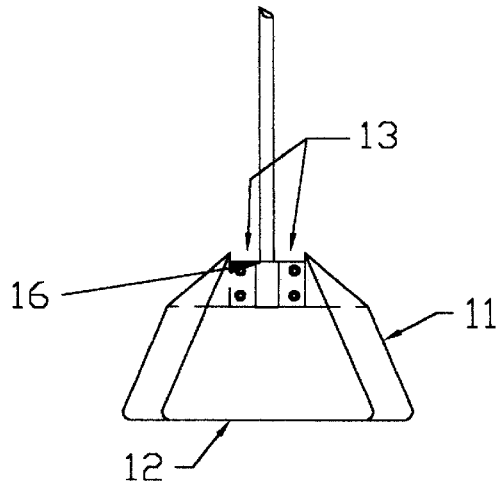

FIG. 33 is a front elevation view of a trapezoidal frame with cutouts.

Figure 34:
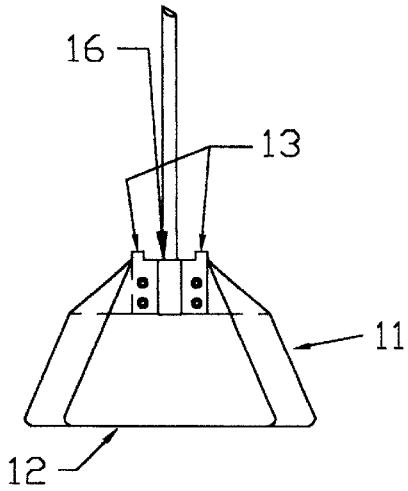

FIG. 34 is a front elevation view of a trapezoidal frame with extensions.

Figure 35:
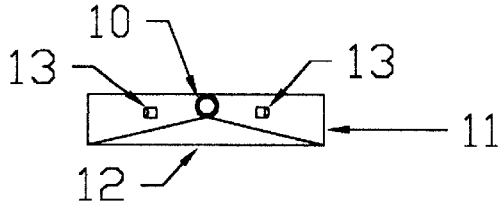

FIG. 35 is a top elevation view of an angled triangular frame with attachments.

Figure 36:
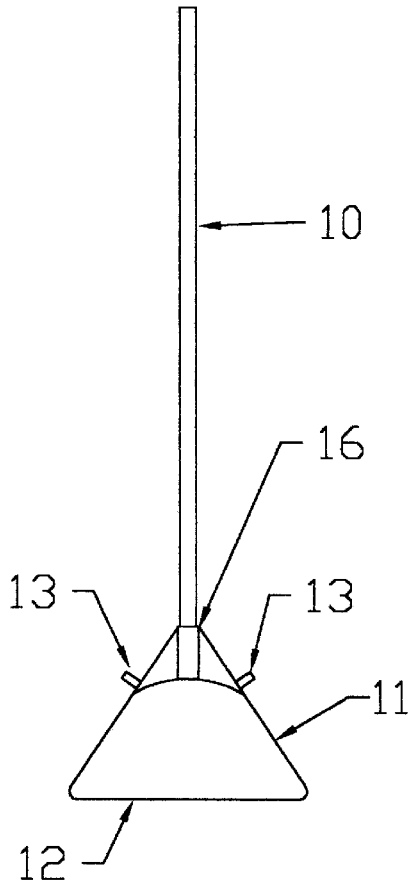

FIG. 36 is a front elevation view of an angled triangular frame with attachments.

Figure 37:
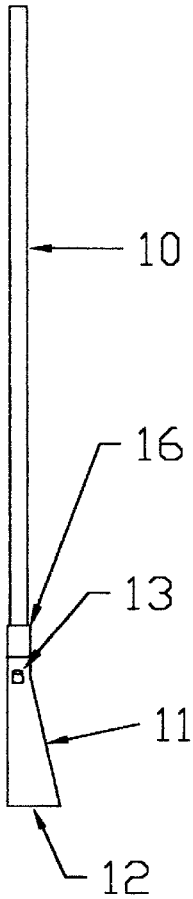

FIG. 37 is a left side elevation view of an angled triangular frame with attachments, the right side being a mirror image of the left side shown.

Figure 38:
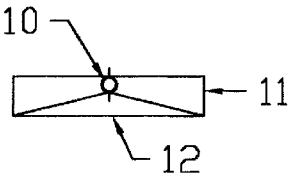

FIG. 38 is a top elevation view of an angled triangular frame with extensions.

Figure 39:
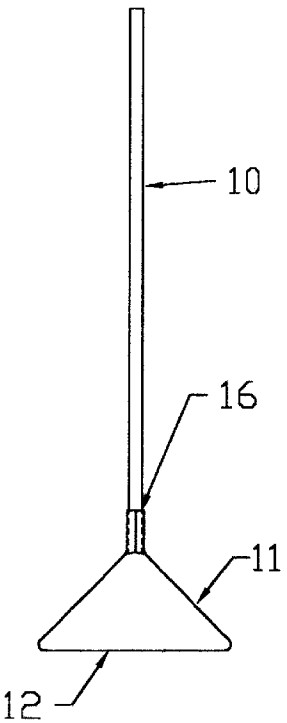

FIG. 39 is a front elevation view of an angled triangular frame with extensions.

Figure 40:
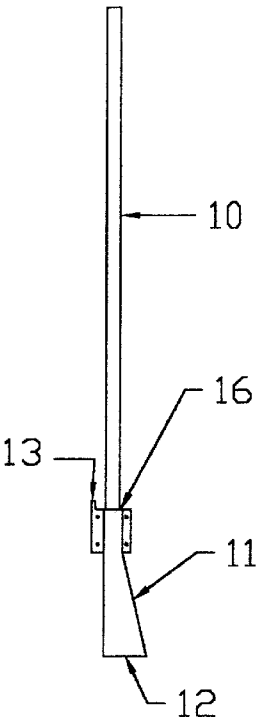

FIG. 40 is a left side elevation view of an angled triangular frame with extensions, the right side being a mirror image of the left side shown. The extension can be positioned on back, front, or both. Shown with back extension.

Figure 41:
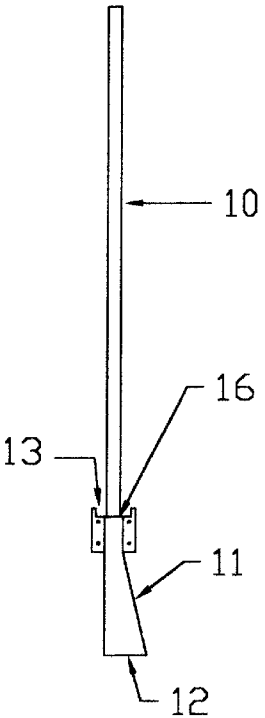

FIG. 41 is a left side elevation view of an angled triangular frame with cutouts, the right side being a mirror image of the left side shown.

Figure 42:
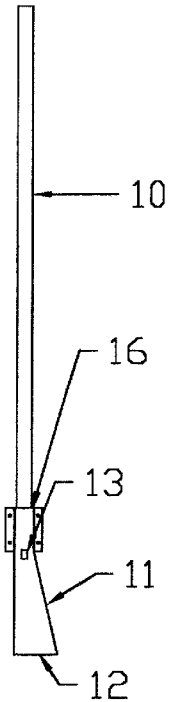

FIG. 42 is a left side elevation view of an angled triangular frame with formed tabs, the right side being a mirror image of the left side shown.

Figure 43:
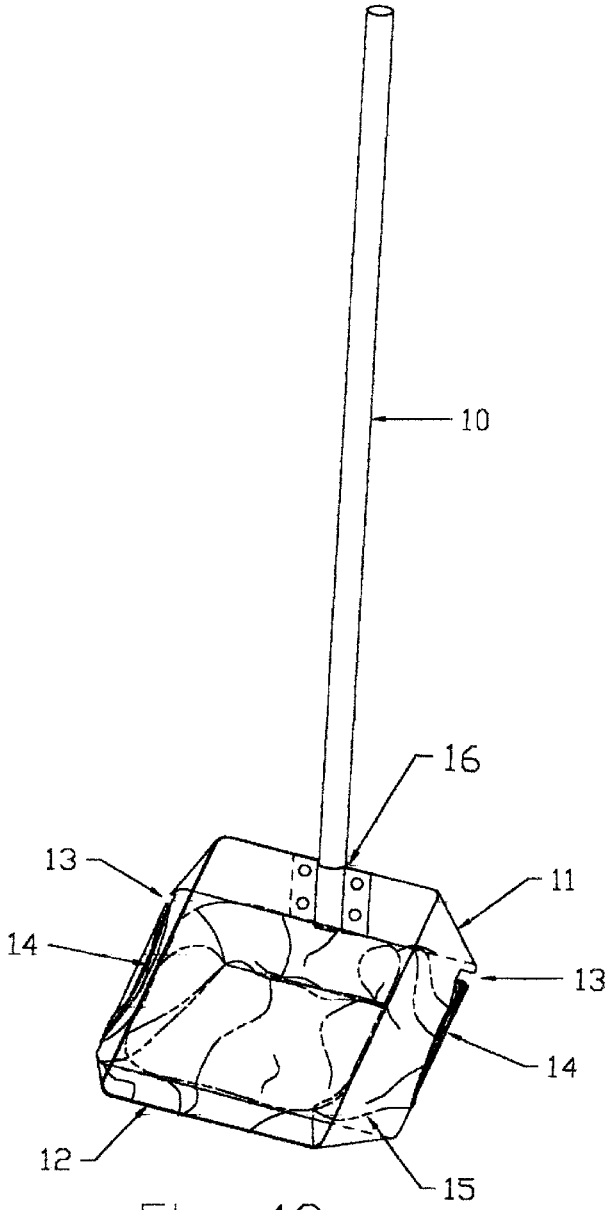

FIG. 43 is a perspective view taken from the top, front, and right side of a portable hand held bagging device showing my new design of the angled rectangular frame with cutouts and attached bag.

Figure 44:
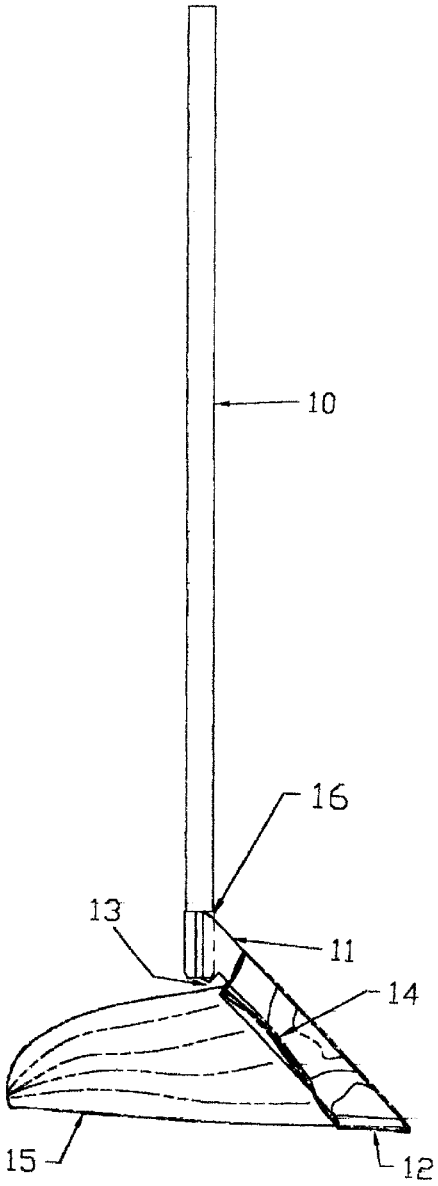

FIG. 44 is a left side elevation view of an angled rectangular frame with cutouts and attached bag.

The broken phantom lines in FIGS. 43 and 44 are meant to depict the outline, folds, and wrinkles of the trash bag.

DETAILED DESCRIPTION OF THE INVENTION

Figure 1:
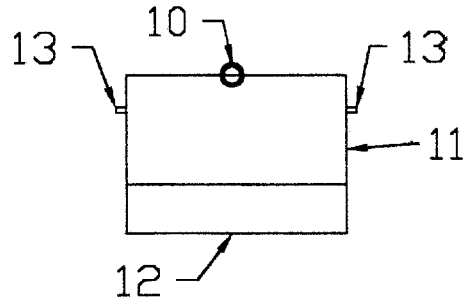
FIG. 1 is a top elevation view of an angled, rectangular, straight pass through frame, having a perpendicular attachment plane for handle, with attachments.
Figure 3:
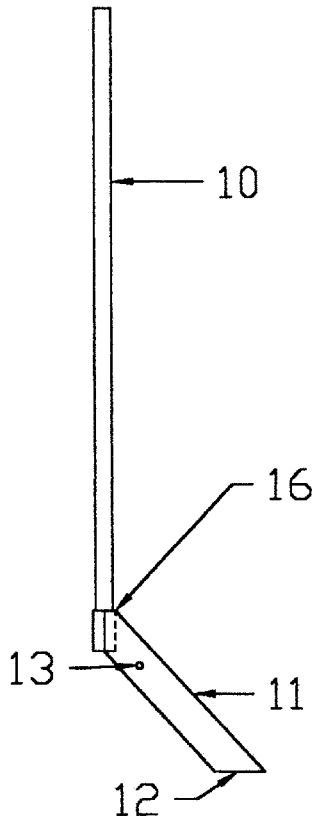
FIG. 3 is a left side elevation view of an angled, rectangular, straight pass through frame, having a perpendicular attachment plane for handle, with attachments, the right side being a mirror image of the left side shown.
Figure 2:
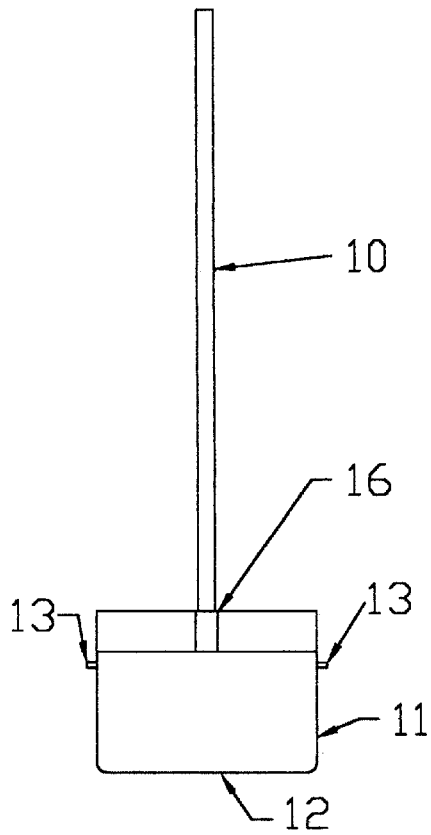
FIG. 2 is a front elevation view of an angled, rectangular, straight pass through frame, having a perpendicular attachment plane for handle, with attachments.

The self-bagging waste collection device of the present invention as seen in FIGS. 1, 2, and 3, comprises a handle 10 having proximal and distal ends. The handle may be composed of wood, plastic, metal, or other substantially rigid, elongated material. The proximal end of the handle 10 is grasped by the user while operating the device. A substantially rigid frame 11 is disposed on the distal end of the handle 10.

Figure 10:
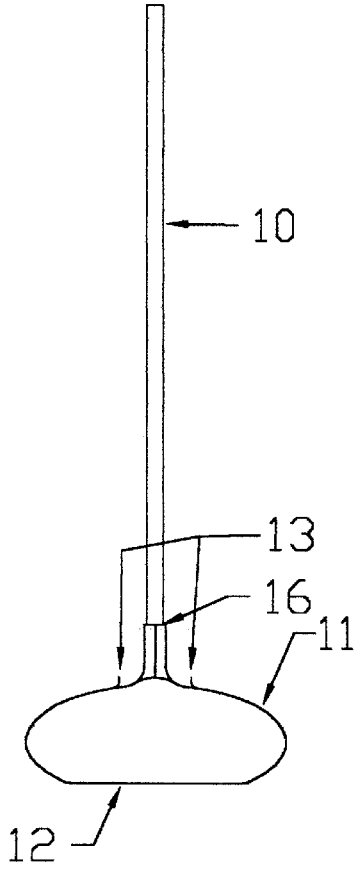
FIG. 10 is a front elevation view of a rounded frame with tabs.
Figure 11:
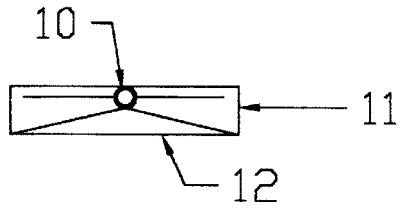
FIG. 11 is a top elevation view of a rounded frame with cutouts.
Figure 13:
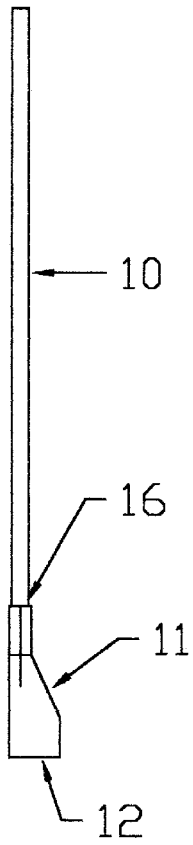
FIG. 13 is a left side elevation view of a rounded frame with cutouts, the right side being a mirror image of the left side shown.
Figure 12:
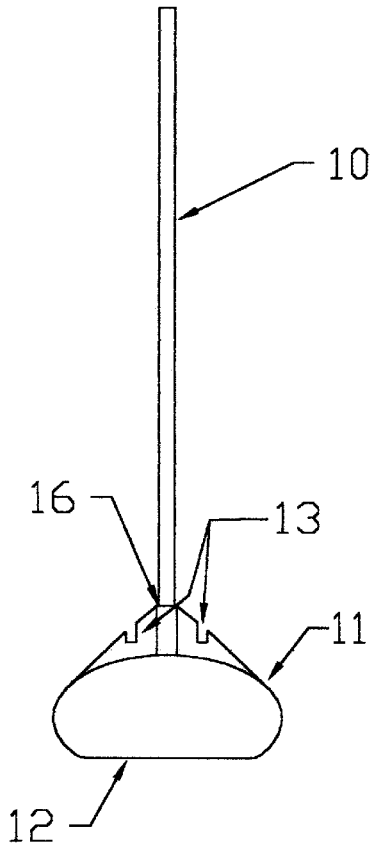
FIG. 12 is a front elevation view of a rounded frame with cutouts.
Figure 14:
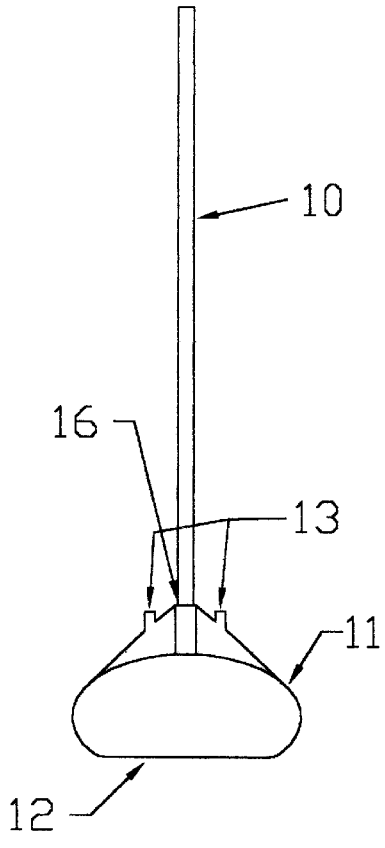
FIG. 14 is a front elevation view of a rounded frame with extensions.
Figure 15:
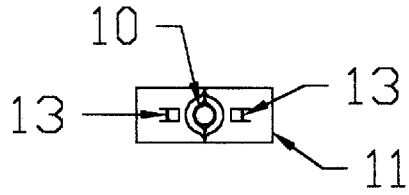
FIG. 15 is a top elevation view of a straight squared frame with formed tabs.
Figure 17:
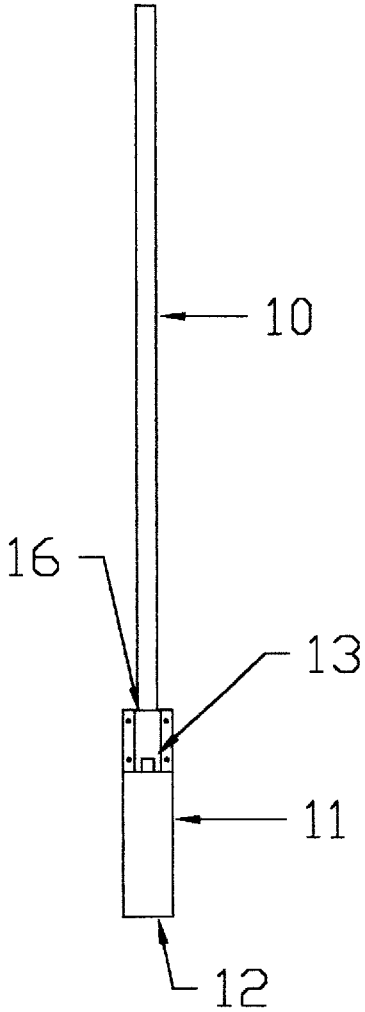
FIG. 17 is a left side elevation view of a straight squared frame with formed tabs, the right side being a mirror image of the left side shown.
Figure 16:
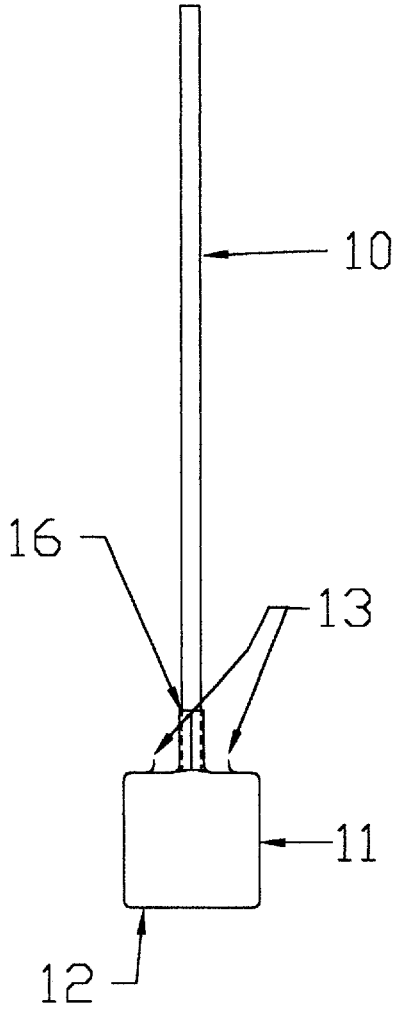
FIG. 16 is a front elevation view of a straight squared frame with formed tabs.
Figure 18:
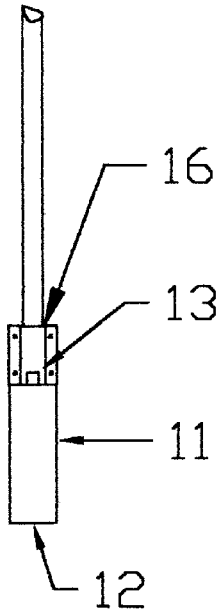
FIG. 18 is a left side elevation view of a straight squared frame with attachments, the right side being a mirror image of the left side shown.
Figure 19:
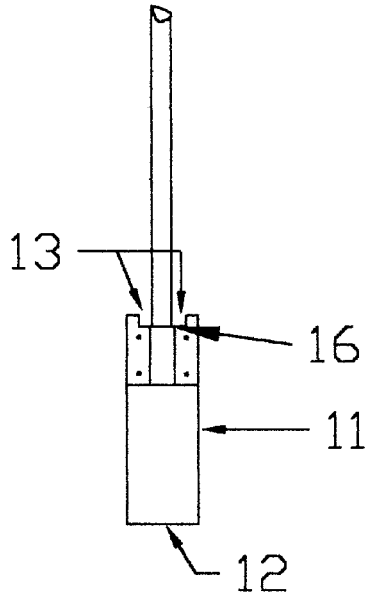
FIG. 19 is a left side elevation view of a straight squared frame with cutouts, the right side being a mirror image of the left side shown.

The frame 11 is attached to handle 10 by handle attachment means 16. Handle attachment means 16 may comprise one of several embodiments. Such may include sandwiching the handle 10 between edges of the frame 11 and riveting the frame edges together on either side of the handle 10 as shown in FIG. 30. Also, as in FIGS. 2 and 10, the frame 11 may extend around and be crimped to the distal end of the handle 10. The frame 11 may also be constructed with a female threaded handle attachment means 16 for acceptance of a handle 10 with male threading on its distal end as in FIG. 22. It should be apparent that the threading of the handle and same may be reversed. Other appropriate handle attachment means 16 such as nails, screws, pins, welding, adhesive and others should be obvious to those skilled in the art.

The frame 11 is an open channeled form defining an interior space that may come in a variety of shapes such as rectangular (FIGS. 1–3 and 21–28), squared (FIGS. 15–20), elliptical (FIGS. 7–14), trapezoidal (FIGS. 29–34), and triangular (FIGS. 35–42). These shapes are preferable, however other shapes would not be excluded. Not all views and configurations are shown. The frame 11 is preferably thin-walled, with sufficient width to provide strength and the ability to incorporate attachment means for the handle 10. The frame 11 may be composed of metal, plastic, composite, wood, or other similar material capable of being configured in the appropriate channeled form.

The frame 11 has a bottom wall 12 which is preferably substantially parallel to the ground. The frame 11 is preferably configured to extend the bottom wall 12 outward from the vertical plane encompassing the handle 10. This forward disposition of the bottom wall 12 eases the user's waste collection ability, allowing the user to sweep the device along the ground to scoop waste, or sweep waste into the device with another implement without any interference from the handle 10.

In one embodiment, the lateral walls of frame 11 may be symmetrical to each other and normal to the same vertical plane to which the bottom wall 12 is normal. This configuration of the lateral walls of the frame 11 is beneficial if the frame 11 is to be manufactured by a molding process, for example plastic injection molding. In this frame 11 configuration, a simple two piece mold is all that is required.

In another embodiment, the lateral walls of the frame 11 may be formed at dihedral angles with the bottom wall 12 while maintaining symmetry with each other. This embodiment is preferable when the frame 11 is constructed using a single band or ribbon of material. Bending the lateral walls of the frame 11 at such complex angles gives the frame 11 added strength and, when bent again in complementary dihedral angles near the attachment point for the handle 10, completes a conversion of the horizontally planed bottom wall 12 of the frame 11 into a vertically planed edge for attachment to the handle 10 while simultaneously disposing the bottom wall 12 forward of the vertical plane of the handle 10.

Figure 4:
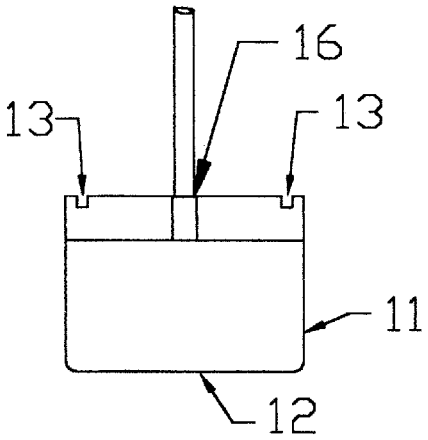
FIG. 4 is a front elevation view of an angled, rectangular, straight pass through frame, having a perpendicular attachment plane for handle, with cutouts.
Figure 5:
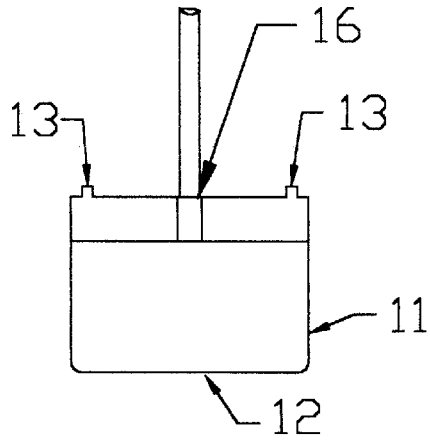
FIG. 5 is a front elevation view of an angled, rectangular, straight pass through frame, having a perpendicular attachment plane for handle, with extensions.
Figure 6:
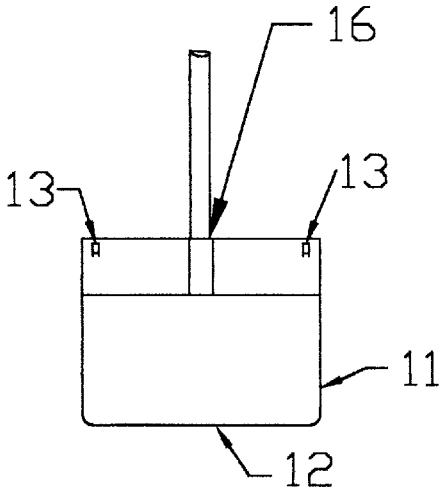
FIG. 6 is a front elevation view of an angled, rectangular, straight pass through frame, having a perpendicular attachment plane for handle, with tabs.
Figure 7:
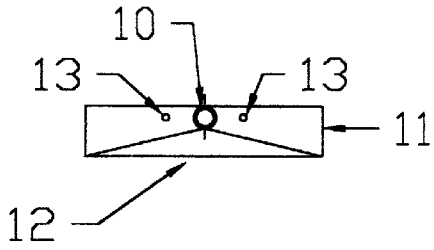
FIG. 7 is a top elevation view of a rounded frame with attachments.
Figure 9:
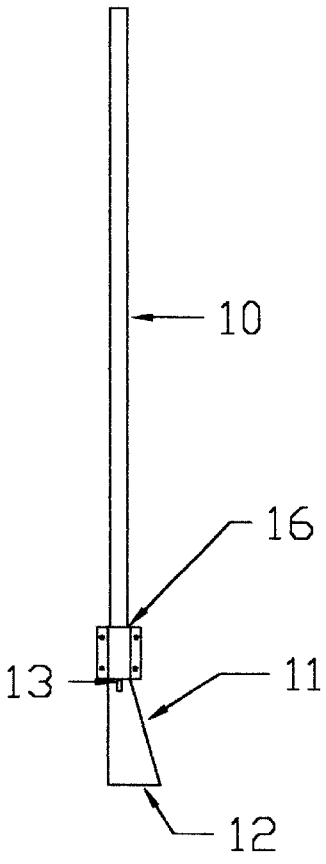
FIG. 9 is a left side elevation view of a rounded frame with attachments, the right side being a mirror image of the left side shown.
Figure 8:
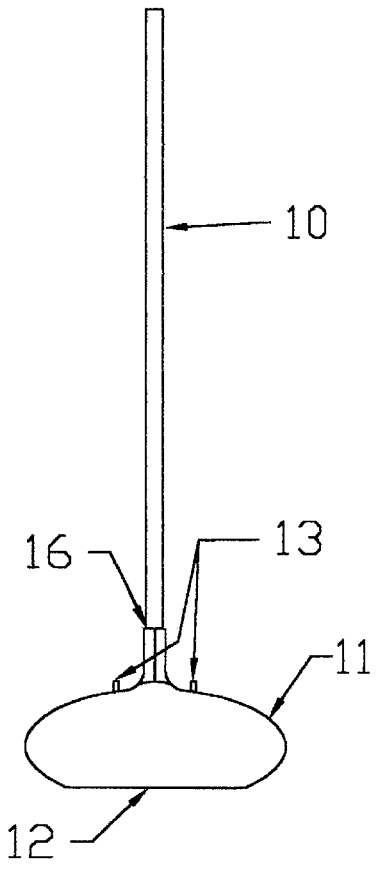
FIG. 8 is a front elevation view of a rounded frame with attachments.

The frame 11 has attachment means 13 that hold the bag 15 operatively in place. The attachment means 13 are placed at a location away from the active portion of the frame. The active portion of the frame is the bottom wall 12 that comes in contact with the ground. The attachment means 13 may be a cutout or slot (FIG. 4), an extension (FIG. 5), a protrusion (FIG. 43), a tab (FIG. 6), or a device mounted on or affixed to the frame, such as a pin, screw, hook, or dowel as in FIGS. 1–3, or any similar attachment means. It should be obvious to those skilled in the art that handle and bag attachment means that are shown for one frame configuration may also be used on other frame shapes and configurations.

A bag 15 such as a plastic bag from a grocery store or other similarly sized plastic shopping bag with bag handles 14 is attached to the device in the following manner. Leading with the open end of the plastic bag 15, the bag 15 is partially inserted through the opening in the frame 11 from the rear. One edge of the plastic bag 15 between the bag handles 14, defining the perimeter of the opening of the bag 15, is fitted and pulled around the bottom wall 12 of the frame 11. The bag handles 14 are then pulled over the lateral walls of the frame and attached to the frame 11 by looping the bag handles 14 over the corresponding frame attachment means 13. The outside of the bag 15 thereby completely covers both faces of the bottom wall 12 and at least the interior faces as well as a substantial portion of the exterior faces of the lateral walls of the frame 11, preventing any soiling of the frame by either the collected waste material or the ground. The waste material and the ground will only have contact with the interior surface of the bag 15.

The attachment means are located symmetrically to each other in positions that will hold the bag 15 in operable position and prevent the bag 15 from disengaging from the bottom wall 12. The positions of the attachment means 13 can generally be described as located symmetrically on the frame 11 on opposing sides of the bottom wall 12, such that the distance along the perimeter of the frame 11 between the attachment means 13 inclusive of the bottom wall 12 is roughly equivalent to the perimeter distance of the opening in the bag 15 along one edge between the centers of bag handles 14. This improved method of attachment results in significantly greater tension in the fit of the bag 15 along the perimeter of the frame 11. By this manner of attachment the bag 15 remains firmly in place and will accommodate several pounds of waste. No special fittings or clamps are required.

I claim:

1. A waste collection device for use with a receptacle, having receptacle handles and an opening, the device comprising:

a. an elongated handle with a proximal and distal end;

b. a rigid frame disposed on the distal end of the handle, the frame defining a channeled opening; and c. receptacle attachment means for attaching the receptacle handles of the receptacle, wherein the receptacle attachment means are symmetrically located on the frame on opposing sides of the frame such that the distance along the perimeter of the frame between the receptacle attachment means, inclusive of a bottom wall, is substantially the same as the distance between the midpoints of the receptacle handles along the perimeter of the receptacle opening, whereby attachment of the receptacle causes the perimeter of the receptacle opening between the midpoints of the receptacle handles to stretch taughtly over and around the frame to impede soiling of the frame from waste being collected, wherein the frame further comprises lateral walls which form dihedral angles with the bottom wall.

2. The waste collection device of claim 1 wherein the bottom wall of the frame is disposed forward of an approximately vertical plane containing the handle.

3. The waste collection device of claim 1 wherein the bottom wall of the frame is substantially disposed in an approximately horizontal plane during use.

4. The waste collection device of claim 3 wherein the frame further comprises lateral walls which are symmetrical to each other and normal to an approximately vertical plane to which the bottom wall is normal.

5. The waste collection device of claim 3 wherein the frame further comprises lateral walls which are symmetrical to each other and formed at dihedral angles with the bottom wall.

6. The waste collection device of claim 5 wherein the frame further comprises a top wall which extends in an approximately vertical plane during use and with which the lateral walls form dihedral angles, which angles are complementary to the dihedral angles formed between the lateral walls and the bottom wall.

7. The waste collection device of claim 6 wherein the configuration of the frame provides increased structural strength as a result of the use of dihedral angles to the approximately vertical top plane.

8. The waste collection device of claim 1 wherein the frame further comprises a top wall which extends in an approximately vertical plane during use.

9. The waste collection device of claim 1 wherein the frame is disposed on the distal end of the handle by a handle attachment means.

10. The waste collection device of claim 9 wherein the frame further comprises a top wall which extends in an approximately vertical plane during use, and the handle attachment means comprises a sandwich wherein the distal end of the handle is placed between overlapping segments of the top wall which segments are fastened together in either side of the handle by rivets or similar fastening means.

11. The waste collection device of claim 9 wherein the frame further comprises a top wall which extends in an approximately vertical plane during use, and the handle attachment means comprises a crimp wherein the distal end of the handle is placed within surrounding segments of the top wall which segments are crimped to the handle.

12. The waste collection device of claim 8 wherein the frame further comprises a top wall and the handle attachment means comprises a threaded union, wherein the top wall comprises a threaded receptacle and the distal end of the handle comprises an oppositely threaded receptacle and the distal end of the handle comprises an oppositely threaded structure, and whereby the handle and frame are screwed together.

13. The waste collection device of claim 9 wherein the frame further comprises a top wall which extends in an approximately vertical plane during use, and the handle comprises an appropriate handle attachment means selected from the group consisting of nails, screws, pins, tabs, welding, adhesives or other obvious attachment methods.

14. The waste collection device of claim 1 wherein the device is for use with a receptacle comprising a common plastic grocery or shopping bag.

* * * * *